United States Patent [19]

White

[11] Patent Number: 4,928,862

[45] Date of Patent: May 29, 1990

[54] TILTABLE LADLE AND COVER FOR SUCH LADLE

[75] Inventor: Douglas S. White, Cap D'Antibes, France

[73] Assignee: Elkem a/s, Norway

[21] Appl. No.: 371,282

[22] Filed: Jun. 23, 1989

[30] Foreign Application Priority Data

Aug. 4, 1988 [NO] Norway ..... 883455

[51] Int. Cl.[5] ..... B22D 41/04

[52] U.S. Cl. ..... 222/604; 266/275

[58] Field of Search ..... 222/604, 605; 266/275, 266/245, 200; 432/262, 263

[56] References Cited

U.S. PATENT DOCUMENTS

| | | | |
|---|---|---|---|
| 1,624,553 | 4/1927 | Koegle | 222/604 |
| 4,324,392 | 4/1982 | White et al. | 222/604 |
| 4,488,711 | 12/1984 | Isenberg et al. | 222/604 |

*Primary Examiner*—S. Kastler
*Attorney, Agent, or Firm*—Lucas & Just

[57] ABSTRACT

The present invention relates to a tiltable ladle having a cover and a suspension frame said suspension frame comprising two lifting arms rotatably connected to trunnions affixed to the outside of the wall of the ladle and a horizontal beam above the ladle equipped with a hook. The top of the ladle and the ladle cover are formed as segments of a cylinder, the focal axis at these cylinder segments being the pivotal axis at the ladle, and the cover being affixed to the suspension frame.

According to another embodiment the focal axis of these cylinder segments are placed at one side of, above, at, or blow the pivot axis of the ladle, the ocover being affixed to the suspension frame, in such a way that the cover closes the ladle when the ladle and the suspension arms are in vertical position.

4 Claims, 5 Drawing Sheets

TILTABLE LADLE AND COVER FOR SUCH LADLE

The present invention relates to a tiltable ladle and a cover for such ladle.

Numerous benefits are available when processing molten metals, if covers are used on ladles or other molten metal containment and treatment vessels. Where covers are used there are frequently problems associated with the mechanics of opening and closing the cover to allow metal charging, slag removal etc. These problems can be fouling mechanics due to metal or slag splashing, time delays in opening and closing the cover, metal spillage if cover mechanics are rough, and labour intensive operations.

It is an object of the present invention to provide a ladle and cover which reduces the above problems and wherein the cover can be opened and closed atomatically when required and where the design of the ladle and the cover is simple and reliable.

According to a first aspect of the present invention there is provided a tiltable ladle having a cover and a suspension frame said suspension frame comprising two lifting arms rotatably connected to trunnions affixed to the outside of the wall of the ladle and a horizontal beam above the ladle equipped with a hook, characterized in that the top of the ladle and the ladle cover are formed as segments of a cylinder, the focal axis of these cylinder segments is the pivotal axis of the ladle, and that the cover being affixed to the suspension frame.

According to a preferred embodiment of the invention the cover is affixed to the suspension frame in such a way that there is a gap between the cover and the ladle.

According to another aspect of the present invention there is provided a tiltable ladle having a cover and a suspension frame, said suspension frame comprising two lifting arms rotatably connected to trunnions affixed to the outside of the wall of the ladle and a horizontal beam above the ladle equipped with a hook, characterized in that the top of the ladle and the ladle cover are formed as segments of a cylinder, the focal axis of these cylinder segments being placed at one side of, above, at or below the pivot axis of the ladle, the cover being affixed to the suspension frame in such a way that the cover closes the ladle when the ladle the suspension arms are in vertical position.

Figure 1:
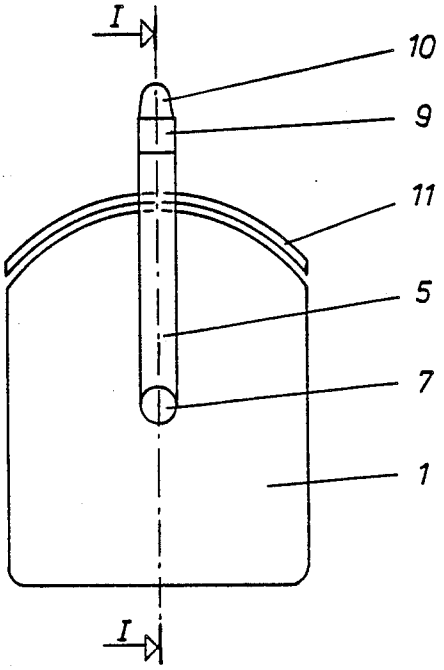
Figure 2:
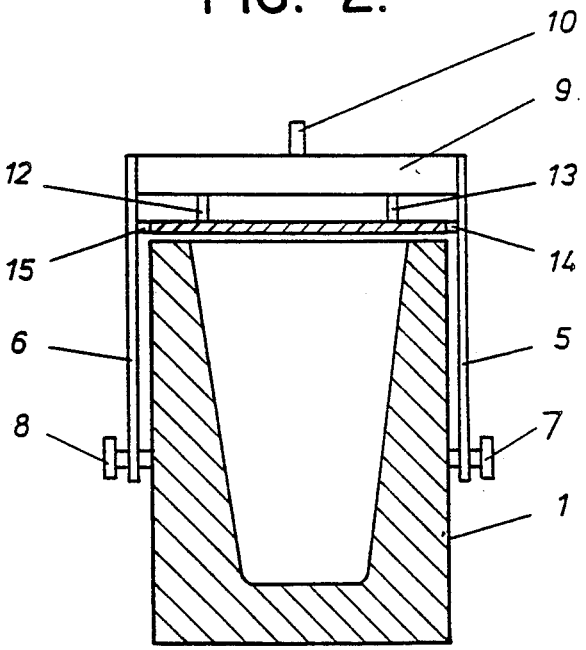
Figure 3:
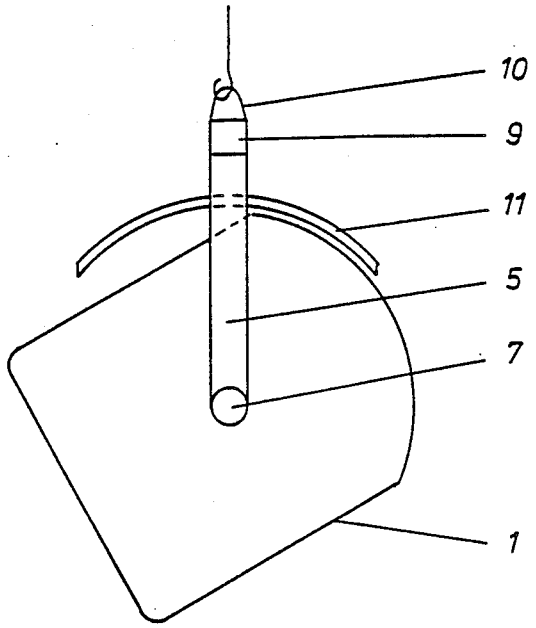
Figure 4:
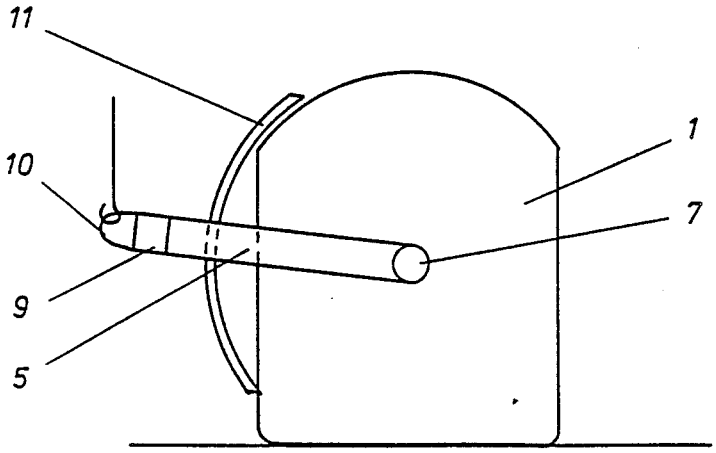
Figure 5:
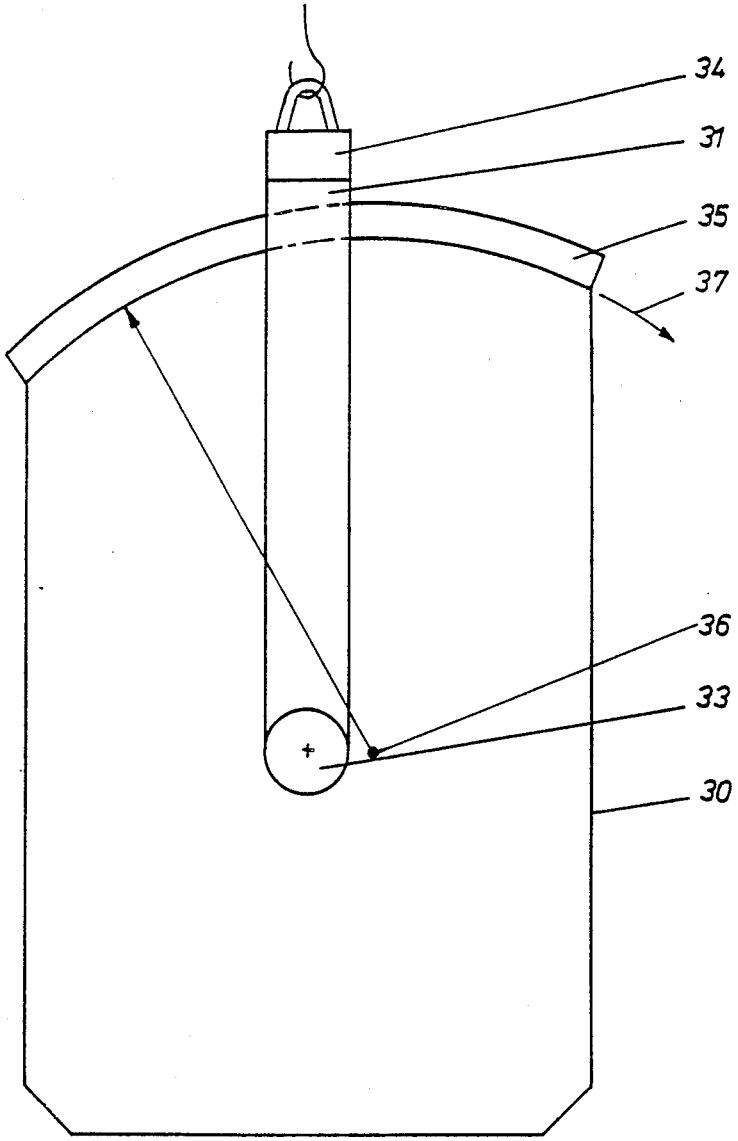
Figure 6:
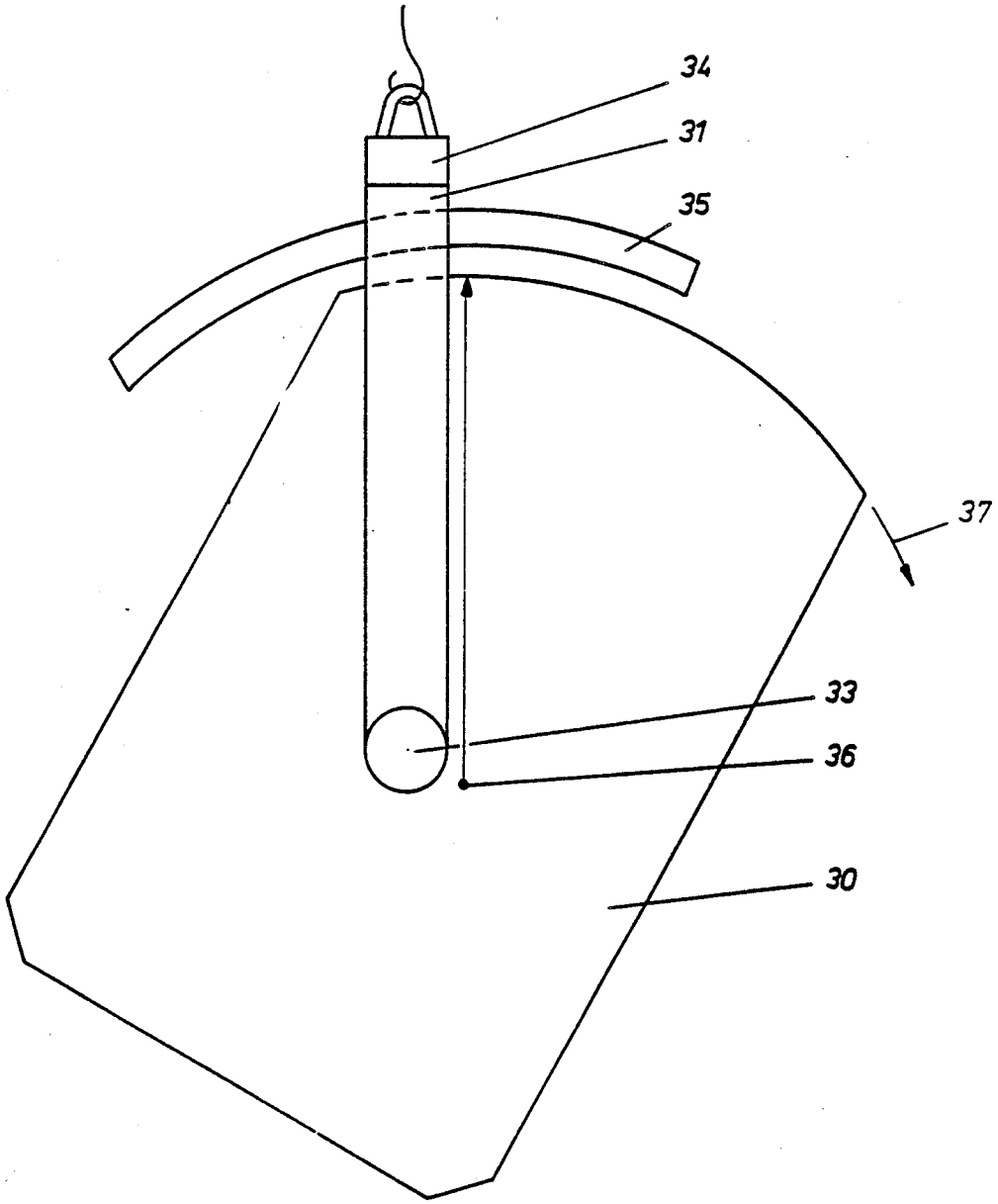
Figure 7:
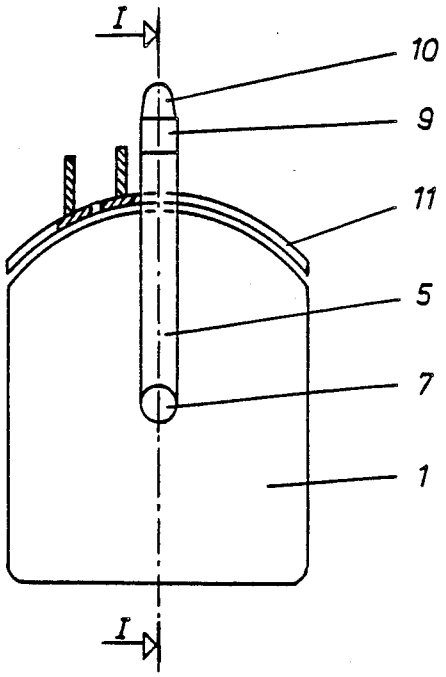

The two aspects of the present invention will now be further described with respect to the accompanying drawings wherein:

FIG. 1 shows a ladle and a cover according to a first aspect of the present invention, FIG. 2 is a cross-section taken along line I—I in FIG. 1, FIG. 3 shows the ladle of FIG. 1 in tilted position, FIG. 4 shows the ladle of FIG. 1 in vertical position and the suspension frame and the cover in tilted position, FIG. 5 shows a ladle and a cover according to a second aspect of the present invention, and FIG. 6 shows the ladle of FIG. 5 in tilted position.

In FIGS. 1 to 4 there are shown a ladle 1. The ladle is equipped with a suspension frame comprising two ladle suspension arms 5, 6 rotatably connected to trunnions 7, 8 fixed to the outside of the ladle 1, and a horizontal beam 9 above the ladle 1. The horizontal beam 9 has a hook 10. A cover 11 is fixed to the suspension frame either by a first set of pins 12, 13, or alternatively by a second set of pins 14, 15, or both.

The top of the ladle 1 and the cover 11 are formed as segments of a cylinder, the focal axis of these cylinder segments being the pivot axis of the ladle. As can be seen from FIG. 1 the cover 11 is arranged in such a way that there is a small gap between the top of the ladle 1 and the cover 11.

Due to the suspension of the cover and the shape of the cover and the top of ladle, the ladle can be freely tilted as shown on FIG. 2. Further the suspension frame and thereby the cover can be lowered so that the cover automatically will be moved away from the ladle when the ladle is resting on a floor or the like. In this way molten metal and additives can be charged into the ladle.

In FIGS. 5 and 6 there is shown another aspect of the present invention. In FIGS. 5 and 6 there is shown a ladle 30 having a suspension frame comprising two ladle suspension arms 31, 32 (not shown) rotatably connected to trunnions 33, fixed to the outside of the ladle 30, and a horizontal beam 34 above the ladle 30. A ladle cover 35 is affixed to the suspension frame in the same way as described above in connection with FIGS. 1 to 4.

The top of the ladle 30 and the cover 35 are formed as segments of cylinders, the focal axis 36 of these cylinders being arranged outside of the pivot axis of the ladle, the pivot axis being the axis connecting the fixing points for the trunnions 33. As shown on FIG. 5 and 6 the focal axis 36 of the segments of the cylinders are situated to the side of the pivot axis of the ladle 30.

When the ladle suspension arms 31, 32 (not shown) and the ladle 30 is in vertical position the cover 35 closes the ladle.

The ladle 30 can now only be rotated in the direction shown by arrow 37 in FIGS. 5 and 6. As soon as the ladle starts to tilt the top of the ladle 30 will start to move away from the cover 35 and allow free tilting of the ladle. When the ladle is tilted back to its vertical position the cover will again close the ladle.

The cover of such a ladle may be merely a cover or it may also be a cover equipped with a filling basin, commonly referred to as a "tundish".

I claim:

1. In a tiltable ladle having a cover and a suspension frame said suspension frame comprising two lifting arms rotatably connected to trunnions affixed to the outside of the wall of the ladle and a horizontal beam above the ladle equipped with a hook, the improvement comprising the top of the ladle and the ladle cover are formed as segments of a cylinder, the focal axis at these cylinder segments being the pivotal axis at the ladle, and that the cover being affixed to the suspension frame.

2. A tiltable ladle according to claim 1, wherein that the cover is affixed to the suspension frame in such a way that there is a gap between the cover and the ladle.

3. In a tiltable ladle having a cover and a suspension frame, said suspension frame comprising two lifting arms rotatably connected to trunnions affixed to the outside of the wall of the ladle and a horizontal beam above the ladle equipped with a hook, the improvement comprising the top of the ladle and the ladle cover are formed as segments of cylinders, the focal axis of these cylinders being placed at one side of, above, at or below the pivot axis of the ladle, the cover being affixed to the suspension frame, in such a way that the cover closes the ladle when the ladle and the suspension arms are in vertical position.

4. A tiltable ladle according to claim 1, wherein that the cover is equipped with a filling basin.

* * * * *